United States Patent [19]

Pasternak

[11] Patent Number: 4,503,850

[45] Date of Patent: Mar. 12, 1985

[54] COLD PROTECTION SUIT HAVING A PROTECTIVE BREATHING DEVICE

[75] Inventor: Adalbert Pasternak, Bad Schwartau, Fed. Rep. of Germany

[73] Assignee: Drägerwerk Aktiengesellschaft, Fed. Rep. of Germany

[21] Appl. No.: 570,494

[22] Filed: Jan. 13, 1984

[30] Foreign Application Priority Data

Jan. 22, 1983 [DE] Fed. Rep. of Germany ..... 3302114

[51] Int. Cl.[3] ..... A62B 7/10

[52] U.S. Cl. ..... 128/201.25; 128/202.26; 128/402

[58] Field of Search ..... 128/201.25, 201.29, 128/202.19, 202.26, 204.17, 402, 201.13

[56] References Cited

U.S. PATENT DOCUMENTS 3,049,896 8/1962 Webb ..... 128/201.25

3,229,681 1/1966 Gluckstein ..... 128/402

*Primary Examiner*—Henry J. Recla

*Attorney, Agent, or Firm*—McGlew and Tuttle

[57] ABSTRACT

In places with a cold ambience and endangered by water bursts, such as diving chambers and submarines, failures in breathing gas supply as well as undercooling may occur upon an accident. The inventive cold protection suit circumvents such dangerous situations in a simple and reliable way. The protective suit is a multilayer wall structure made up of partial casings which can be put on individually, namely a body casing, an intermediate casing, and an outer casing. The intermediate casing has two walls of a material semipermeable to respiratory gas which are spaced apart from each other and form pockets. The pockets are filled with a chemical known per se by which carbon dioxide is exothermally fixed and oxygen is released. The exhaled air is directed through a breathing mask and exhalation tube into passages which are formed between the outer and the intermediate casing. Therefrom, the exhaled air penetrates through one semipermeable wall, the chemical within the walls out the other semipermeable wall into passages adjacent the body casing, and it gives off heat to the user of the suit, and flows back to the breathing mask.

13 Claims, 2 Drawing Figures

COLD PROTECTION SUIT HAVING A PROTECTIVE BREATHING DEVICE

FIELD AND BACKGROUND OF THE INVENTION

This invention relates in general to personnel protection devices and in particular to a new and useful cold protection suit which is usable with a respirator.

In places with a cold ambience and endangered by water bursts, such as diving chambers and submarines, failures in breathing gas supply as well as undercooling may occur upon an accident. Situations of this kind must be encountered in a simple and effective way.

A prior art protective breathing apparatus is intended for ambiences endangered by undercooling. The apparatus comprises a cartridge by which $CO_2$ from the respirator gas is fixed and $O_2$ is released and which is operated in reciprocation. The cartridge is connected through an accordion tube and a mouthpiece to the user. A heat accumulator is provided between the cartridge and the ambient air. This heat accumulator stores the heat contained in the exhaled air and produced in the cartridge and gives it off to the user during the next inhalation. Thus, in the way of the respiratory tract, the user's body is prevented from becoming undercooled and the body temperature is sustained, however, the body surface is not directly heated (German patent application No. 31 50 412.4).

In a prior art dry diving suit for great depths, the suit has inner and outer gastight walls which enclose a space filled with foam material. The walls are thus connected to each other through a layer of foam material. The foam material is a plastic with communicating cells, so that, to some extent, passages are formed. The passages are connected through an inlet valve in the outer wall to a compressed-gas source, such as to the breathing gas tank of the breathing apparatus. The gas penetrating therein prevents the material of the suit from being compressed and thus maintains the thermal insulation (German As No. 12 78 869).

The prior art diving suit may reduce thermal losses, but cannot supply more heat to the user's body.

SUMMARY OF THE INVENTION

The invention is directed to a breathing device combined with a protection against undercooling and improving the protection of crews of diving chambers, submarines, and other vessels, in distress at sea.

In accordance with the invention, a cold protection suit for a person comprises a suit casing which has an inner body casing wall, an outer casing wall spaced of the inner body casing wall and a flow space between the two walls. In the flow space are wall separating construction which defines a chemical chamber for a chemical material to fix carbon dioxide in respiratory gases to liberate oxygen. A chemical container forming wall is made up of two porous walls which are heat sealed together at spaced locations leaving chambers between these heat sealings which are filled with the chemical which fixes the carbon dioxide and liberates oxygen and heat. Between the chemical container forming wall and the outer wall there is an inlet passage for respiratory gases which communicate with the chemical in the chamber and an outlet gas passage defined between the chemical chamber and the inner wall. There is a respiratory gas connection from the respiratory system of the wearer to the inlet passage and there is a connection from the outlet passage to the space defined between a shield which extends from a portion of a head casing which encloses the wearer downwardly in front of the wearer and which includes a viewing window in the area of the face. The shield is spaced outwardly from the front of the body of the wearer and leaves a respiratory opening which is connected to the exhaust connection connected outwardly from the outlet passage of the suit.

With the inventive construction heat which is released by a wearer of the suit utilizes a heat protection for the user of the suit. Exhaled gases are passed into the inlet passage defined in the suit casing and circulated through the chemical and then out through an outlet passage and into a space immediately below the wearer's face between a face shield and the wearer. The shield space continues down in front of the wearer substantially under the beltline of the wearer at which point the gas is exhausted from the outlet passage of the suit exit. With the construction of the suit to provide the tension of heat of the user in his exhaled gases, chances of survival of those in distress are substantially augmented. The structure of the thermally insulating layers of the suit is simple. Zipper closures are provided for pockets and connecting portions of the suit which may be advantageously made substantially gastight. In addition, pockets are provided in the chemical wall so that these walls may be easily filled with a chemical for operating the suit.

Accordingly it is an object of the invention to provide an improved suit construction for personnel operating in cold conditions.

A further object of the invention is to provide a suit construction which includes a wall formation forming three separate chambers comprising an outer chamber for the inflow of exhaled gases, an intermediate chamber into which the gas is passed for liberating oxygen and fixing carbon dioxide in a discharge chamber through which the gases are circulated and which provide a warming effect to the wearer, which gases are eventually exhaled for passage in the space between a front apron shield of the wearer and the suit outer wall.

A further object of the invention is to provide a cold protection suit which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
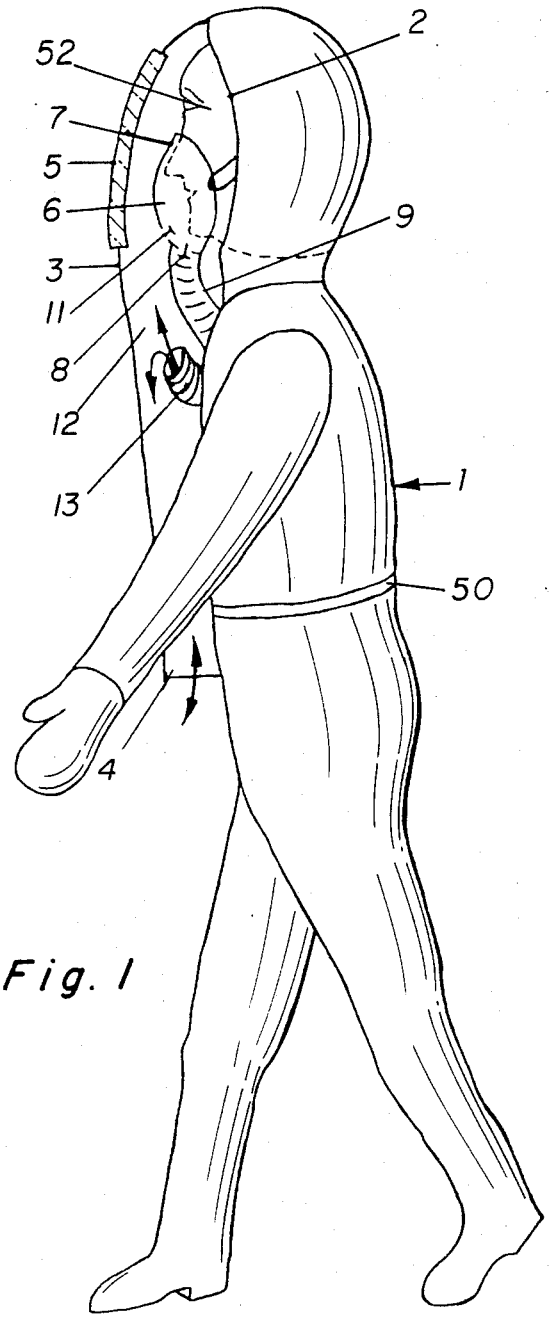
FIG. 1 is a side elevational view of a person wearing a cold protective suit constructed in accordance with the invention.

Referring to the drawings in particular, the invention embodied therein comprises a cold protection suit generally designated 1 for a wearer 52 whose is only partially covered by the suit so that the front of the face may be easily connected to a breathing mask 7. In accordance with the invention, the suit casing 1 has an inner body casing wall 15, an outer casing wall 17 spaced outwardly of the inner casing wall and a flow space defined between these walls. Wall means in the form of spaced porous walls 18 and 18' are joined together at spaced locations which is by heat sealing at 19 so as to form chemical chambers 21 between the spacings between the flow passage which is divided by the chemical wall into an inlet passage 10 and an outlet passage 14. Respiratory gas connection means in the embodiment shown includes a breathing mask 7 positioned over the nose, mouth and chin of a wearer so that the user discharges to an exhaling valve 8, into an exhalation tube 9 which connects to the inlet 10. The respiratory gas connection means further includes an outlet tube 13 which discharges into a space 12 between a shield generally designated 3 which fits over the face of the wearer and is secured along a seam line 2 to the suit 1. The space 12 is open downwardly through a respiratory opening 4 which discharges to atmosphere.

The cold protection suit 1 covers the entire body of the user, except for the face. The sealing line 2 between the suit and the body extends around the face. The face is covered with a shield 3 which is firmly connected to suit 1. The shield has respiratory opening 4 and is provided in a field of vision with a window 5.

The breathing equipment 6 comprises a breathing mask 7 which is connected at the exhalation side through exhaling valve 8 and exhalation tube 9 to inlet passages in the wall of the suit (FIG. 2), and through an inhaling valve 11 to the space 12 inside of shield 3. An outlet tube 13 communicating with outer passages 14 in the wall of the suit leads to space 12 in addition.

Figure 2:
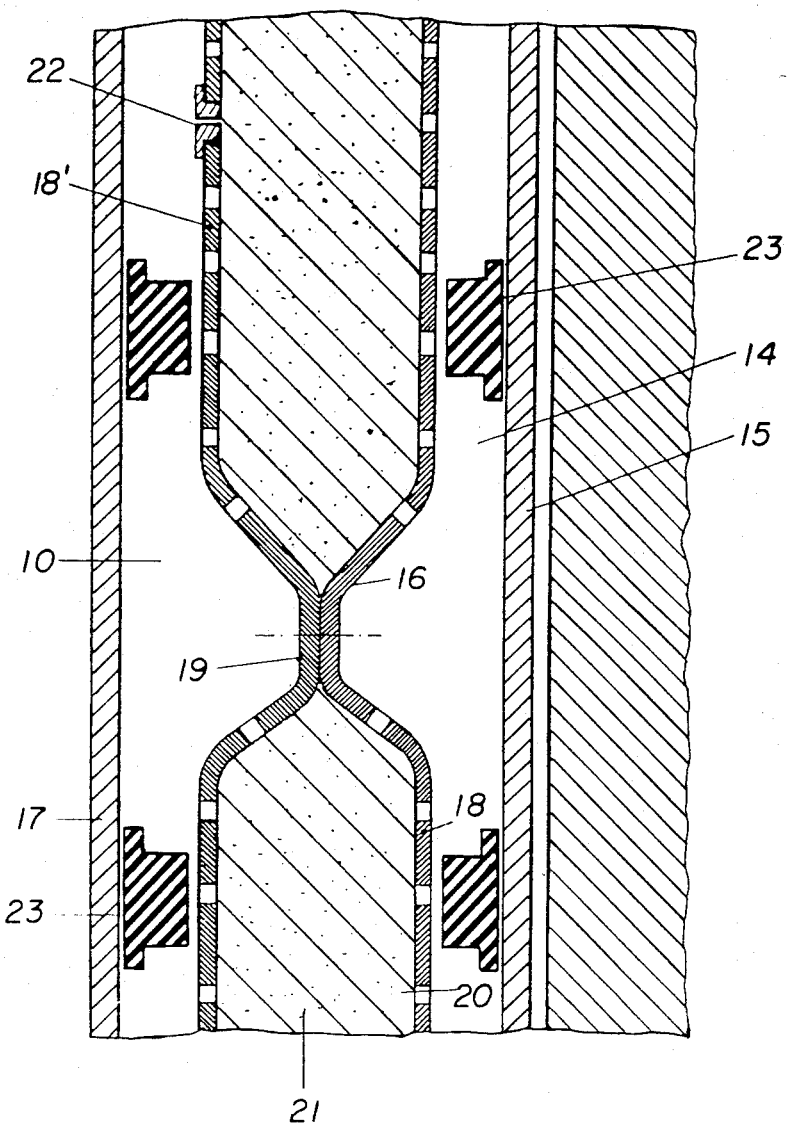
FIG. 2 is an enlarged detail of the cross section of a wall of the suit shown in FIG. 1.

FIG. 2 shows the wall structure of the suit. The suit is built up of three casings which can be put on individually, namely a body casing 15, an intermediate casing 16, and an outer casing 17. Certain portions of these casings, such as for hands and the face, may form parts which may be put on separately and are secured through gastight zipper closures 50.

Intermediate casing 16 is made with two walls 18 and 18' which are permeable to respiratory gas and connected to each other at definitely spaced locations 19, for example by heat sealing, or by an adhesive, to form pockets 20. Pockets 20 are filled with a chemical known per se, such as $KO_2$, by which $CO_2$ is fixed under heat release and $O_2$ is given off. The chemical can exothermally react with water too. Zipper closures 22 are provided to facilitate the filling.

Body casing 15 adjacent the user's body and outer casing 17 carry spacers 23 which are secured thereto by heat-sealing, vulcanization, and adhesive, etc., and through which they apply against intermediate casing 16. Inlet passages 10 are thereby formed adjacent outer casing 17, and outlet passages 14 adjacent body casing 15.

The user exhales through half-face mask 7, exhaling valve 8, and an exhalation tube 9, into inlet passages 10 of the wall structure of the suit. The exhalation air rich in water vapor and $CO_2$ is distributed over the entire area of intermediate casing 16 and penetrates through wall 18 which is permeable to gas (the material may be cuprophane, cellulose acetate, etc.), a chemical in chamber 21, and the other wall 18, into outer passages 14. The reaction taking place in the chemical of chamber 21 produces heat and releases oxygen. The heated respiratory air freed from $CO_2$ and enriched with $O_2$ flows through outlet passages 14, while transferring heat to the body, and through outlet tube 13 into space 12 where it is again available for being inhaled through inhaling valve 11. While a specific embodiment of the invention has been shown and described in detail to illustrate the application of the principles of the invention, it will be understood that the invention may be embodied otherwise without departing from such principles.

What is claimed is:

1. A cold protection suit for a person, comprising a suit casing for substantially covering a person's body, arms and legs, and having an opening at least for the persons's face, said suit casing having an inner body casing wall, an outer casing wall spaced outwardly of said inner body casing wall leaving a flow space therebetween, wall means extending throughout a major portion of said suit casing between said inner body casing wall and said outer casing wall defining a chemical chamber therebetween, an inlet flow chamber on one side of said chemical chamber wall bounded by said chemical chamber wall and said outer casing wall and an outlet flow chamber on the opposite side of said chemical chamber bounded by said chemical chamber wall and said inner casing wall, and means passage connecting said inlet flow chamber to said chemical chamber and said chemical chamber to said outlet flow chamber, a face mask engageable over at least a nose and mouth of the person's face, having an exhalation tube connected into said inlet flow chamber of said suit casing, a separate exhaust tube connected to said outlet flow chamber, and a shield connected at its periphery to said suit casing about said opening and extending downward over said opening and the front of said suit casing to define a space between a front of said suit casing below said opening and said shield, said shield defining a downward exhaust discharge, said separate exhaust tube being connected into the space between said shield and the front of said suit casing.

2. A cold protection suit according to claim 1, wherein said suit casing includes a head portion encircling the person's head and defining said opening for the person's face, said shield being attached to said head portion and having an open viewing window through which a person may look, said shield terminating at substantially a waistline of a person wearing the suit of said downward exhaust discharge.

3. A cold protection suit according to claim 1, wherein said passage means comprises said chemical chamber wall means being two perforated walls located between said inner body casing wall and said outer casing wall, means joining said walls together at spaced locations along their length forming chemical chambers between said walls and between said joined portions.

4. A cold protection suit according to claim 3, including spacer means disposed between said wall means forming said chemical chamber and said inner casing wall in said outer body casing wall respectively.

5. A cold protection suit for use with a breathing mask having an inhaling valve and an exhaust discharge tube comprising a suit adapted to fit over a person having a casing with portions adapted to fit over at least the body and head of the person, with an opening for the face of the person to be exposed, the casing made of spaced inner and outer walls so as to define a flow space through the walls, a pair of semipermeable walls positioned in and extending throughout a major portion of the flow space between the inner and outer walls and being joined together at spaced locations so as to leave a chemical chamber between the joined portions for receiving a $CO_2$ absorbing $O_2$ and heat liberating chemical, the joined portions dividing the flow space into an inlet passage from one side and an outlet passage on the other side of said two walls which communicate with the chemical chamber, said inlet passage including means adapted to be connected to said exhaust discharge tube of the breathing mask and a further discharge tube connected to said outlet passage.

6. A cold protection suit according to claim 5, including a shield for extending over the face of the person connected to said casing about said opening and extending downward over the front of the suit and defining a further space in front of the person wearing the suit, the shield having an exhaust opening below said exhaust tube, said further tube exhausting into the further space between said shield and the casing.

7. A cold protection suit according to claim 5, wherein the material of said walls forming said chemical chamber are semipermeable to respiratory gas and are made of cuprohane.

8. A cold protection suit according to claim 5, including spacer means spacing said semipermeable walls from said inner and outer walls of said body casing.

9. A cold protection suit according to claim 5, wherein said semipermeable walls have closable openings therein for recharging the chemical in said chemical chamber.

10. A method of protecting a person against a cold atmosphere, comprising:

covering the body, arms and legs of the person with a protective suit having spaced layers with a flow space therebetween extending throughout a major portion of said protective suit, while the person's face is exposed; directing the person's exhalation into the flow space; and using a chemical disposed in the flow space to fix carbon dioxide and to liberate oxygen and heat, connecting the flow space to a discharge.

11. A method according to claim 11, wherein the gases discharged from the flow space are circulated back to the wearer for inhalation.

12. A method according to claim 11, wherein a further space is formed between the person's face and a shield covering the person's face which is connected to the discharge, the gases which are discharged from the flow space being discharged in said further space for reinhalation by the person.

13. A method according to claim 12, wherein the shield has the discharge adjacent a waist level of the person and the gases which are discharged from the flow space and into the further space between the shield and the person are discharged upwardly in a vicinity of the person's face.

* * * * *